United States Patent [19]

Browning

[11] Patent Number: 4,634,611

[45] Date of Patent: Jan. 6, 1987

[54] FLAME SPRAY METHOD AND APPARATUS

[75] Inventor: James A. Browning, Hanover, N.H.

[73] Assignee: Cabot Corporation, Boston, Mass.

[21] Appl. No.: 739,721

[22] Filed: May 31, 1985

[51] Int. Cl.[4] ..... B05B 7/20

[52] U.S. Cl. ..... 427/423; 239/81; 239/132.3; 239/290

[58] Field of Search ..... 427/34, 37, 423; 118/301, 504; 239/81, 83, 84, 85, 290, 291, 227, 587; 219/121 PL

[56] References Cited

U.S. PATENT DOCUMENTS

| | | | |
|---|---|---|---|
| 3,342,626 | 9/1967 | Batchelor et al. | 427/423 |
| 4,146,654 | 3/1979 | Guyonnet | 427/423 |
| 4,370,538 | 1/1983 | Browning | 239/81 X |

*Primary Examiner*—Shrive P. Beck

*Attorney, Agent, or Firm*—R. Steven Linne; Jack Schuman

[57] ABSTRACT

Disclosed is a method of, and apparatus for, flame spraying particulate material utilizing the thermal energy of a very hot gaseous primary stream produced in an oxy-fuel combustion chamber combined with kinetic energy from a surrounding annular sheath of warm high velocity secondary air.

9 Claims, 2 Drawing Figures

OXYGEN
FUEL GAS
AIR
19
20
14
13
15
16
17
18
12
11
10
9
32
21
22
23
24
26
28
27
29
30
31

10
22
14
17
24
23
20
15
11
26
16
13
21

FLAME SPRAY METHOD AND APPARATUS

TECHNICAL FIELD OF THE INVENTION

This invention relates generally to flame spray coating systems which utilize the hot gaseous products of combustion to heat or melt a particulate material and accelerate the particles toward a substrate to be coated. More specifically, the invention relates to an improved design of an oxy-fuel combustion chamber in combination with a compressed air nozzle and method for using the device to flame spray metal or ceramic powders onto a workpiece to form a dense bonded coating.

BACKGROUND OF THE INVENTION

Thermal spraying is a generic term for a group of industrial processes involving the feeding of a desirable or heat-fusible material into a heating zone to be melted, or at least heat-softened, and then propelled from the heating zone in a finely divided form, generally, for depositing metallic or nonmetallic coatings on a substrate. Thermal spraying was mostly used during the initial stages of its commercial development for spraying metals to repair or build up worn, damaged, or improperly machined parts. Recently, however, a much wider group of materials, including refractory alloys, ceramics, cermets, carbides and other compounds are used to impart wear, corrosion, or oxidation resistance to the base material. These processes, sometimes still collectively called metalizing, broadly include flame spraying, electric-arc spraying and plasma-arc spraying.

These three basic types differ, primarily, in the type of equipment used for the heating zone. Flame spraying utilizes combustible fuel gas (such as acetylene, propane, natural gas, or sometimes hydrogen) which reacts with oxygen or air. Electric-arc and plasma-arc utilize, naturally, electrical energy to produce the heating zone. Additionally, a blast gas may be provided in order to aid in accelerating the heated particles and propelling them from the heating zone toward the surface to be coated and/or to cool the workpiece and the coating being formed thereon.

The detailed characteristics, as well as advantages and disadvantages, of these three basic types of thermal spraying processes are discussed in Volume 5 of the *Metals Handbook Ninth Edition* (pp. 361–368) which is incorporated herein by reference.

The coating material can initially be wire or rod stock, or powdered material. If in the form of wire or rod, it is fed into the heating zone where it is melted. The molten stock is then stripped from the end of the wire or rod and atomized by a high velocity stream of compressed air or other gas which propels the material onto a prepared substrate or workpiece. If in powdered form, the material is usually metered by a powder feeder or hopper into a compressed air or gas stream which suspends and delivers it to the heating zone. The characteristics of suitable flame spray powders are discussed in U.S. Pat. Nos. 3,617,358 and 4,192,672 and the references cited therein.

For purposes of the present invention, flame spraying may be further subdivided into at least three significant commercial variations according to the nature or velocity of the combustion process, which in turn, affects the coating characteristics.

At one extreme are the simple low velocity processes first developed during the early 1900's, apparently in Switzerland, (see, for example, U.S. Pat. Nos. 1,100,602 and 1,128,058) and still widely used today in various commerical embodiments.

Basically, the low velocity process utilizes a small, often hand-held, device having an open or unconfined flame (such as a modified acetylene torch) to heat and transport a metal powder to a workpiece to form a coating for wear or corrosion resistance. The powder is added to the burning flame near the tip of the torch and thus is heated after leaving the device. Since the coating is usually very porous, another flame is often used to fuse or melt the as-deposited powder into a smoother and more dense coating. This type of process is described in much more detail in U.S. Pat. Nos. 2,526,735, 2,800,419, 4,230,750 and the references cited therein.

At the other extreme, is a complex ultra high velocity process developed by Union Carbide in the 1950's which uses periodic detonation waves moving through a long tube (typically about 1 meter in length) to heat and propel powder from one end of the gun.

The velocity of flame propagation in a detonation is hundreds of times faster than during simple combustion and may be many times the speed of sound. A good discussion of this process may be found in U.S. Pat. Nos. 2,714,563 and 2,774,625.

Intermediate these two extremes, is the more recently developed third type of flame spray process which utilizes high velocities near the speed of sound, produced by continuous combustion, not periodic detonation, in a short tube or duct.

This high velocity process utilizes a more massive water-cooled structure having an enclosed combustion chamber, and optionally, an exit nozzle (like a rocket) to accelerate the oxy-fuel flame, and the powder carried therein, to velocities about five or ten times faster than the unconfined flame of the low velocity process. While the temperature of combustion is thought to be about the same for all types of processes, (about 3000° C.) the high velocity processes seem to increase the apparent temperature of the powder less than the low velocity process; probably because of the shorter time available for heating in the hot gas region. However, the combined high velocity and high temperature produce a much denser high quality deposit on the workpiece.

This improved type of oxy-fuel combustion system is described in more detail in U.S. Pat. Nos. 2,990,653, 4,342,551, 4,343,605, 4,370,538 and 4,416,421.

These three major variations of flame spray coating systems each have certain advantages and disadvantages.

Equipment for the low velocity process is very inexpensive and easy to operate but the coatings produced are usually porous and of low quality. Further, a limited number of materials may be sprayed and the metal deposition rate is low due to the low energy input of the burning gases.

Equipment for the ultra high velocity detonation process is complex, expensive and not usually available for sale but the coatings are of high quality. Further, many different types of materials may be sprayed but again at a low deposition rate.

The intermediate velocity process is also intermediate in cost and complexity. Many types of metallic coating materials may be deposited at high rates and at good densities. However, the very high fuel and oxygen consumption results in a somewhat high hourly operating cost.

Prior to the introduction of plasma-arc spraying equipment, high quality (i.e. dense) coatings which use powder as the sprayed material could only be made utilizing a detonation-gun process.

The plasma-arc spraying process provides coatings of somewhat less quality and has a relatively high equipment cost as well as high hourly operating costs.

Many flame spray applications do not require detonation-gun quality coatings. However, prior to the use of the improved oxy-fuel system operating at above critical or sonic velocity, the available low velocity combustion devices produced coatings of much lower quality than even plasma-arc spraying.

Thus, it is one object of this invention to provide an oxy-fuel combustion system capable of producing good quality coatings at reasonable cost. Another object of this invention is to provide a simple air-cooled device having better thermal efficiency than a water-cooled device.

Some prior work has been done in an effort to improve the flame spraying process but no one has heretofore recognized the source of the problems or the advantages of the present invention.

From the earliest days, it has been known that a blast of compressed air may help shape and/or accelerate the particle stream. See, for example, U.S. Pat. Nos. 2,108,998, 2,125,764 and 2,436,335.

There are also a few devices which use a combustion process to produce a hot blast gas instead of the more common compressed air source which produces a cold blast. See, for example, U.S. Pat. Nos. 4,358,053 and 4,370,538.

Some prior devices also use cold blast gas or the combustion air to cool the gun and/or further heat the particles. See, for example, U.S. Pat. Nos. 2,125,764; 4,187,984 and 4,342,551.

However, none of these prior devices disclose the important relationships between the velocities and temperatures of the heating gas and the blast gas.

SUMMARY OF THE INVENTION

This application describes a new method and improved apparatus utilizing an oxy-fuel flame to produce sprayed coatings of good quality. The invention, while somewhat similar to the aforementioned U.S. Pat. No. 4,370,538, is based on the principle of a subsonic, duct-stablized flame for heat softening of particulate material or for melting a continuously fed wire rod. The so-heated material passing from the duct is accelerated to higher velocity beyond the duct by the combined action of the primary stream of hot gases of combustion, and an additional surrounding annular sheath of heated high velocity gas, from, for example, a compressed-air source. This secondary air stream reduces the need for high volumes of fuel and oxygen in the primary stream.

I have found that the relationship between the outer sheath of air, to the inner flow of very hot gas, is of critical importance. The cooler sheath must add its kinetic energy or momentum to the total flow, yet not appreciably lower the temperature of the inner columnar region of the hot gas flow. Premature mixing is minimized by heating the secondary air sheath gases to provide a surrounding jet velocity nearly equivalent to that of the inner hot gas flow, or at least sufficiently close to it, so that the boundary between the two streams is not severly mixed. It is important that at least the primary inner flow, after leaving the device, remain in its subsonic region as matching a supersonic flow velocity of the hot inner portion could not be achieved by the cooler outer sheath.

BRIEF DESCRIPTION OF THE DRAWINGS

While this specification concludes with claims particularly pointing out and distinctly claiming the subject matter which is regarded as the invention, it is believed that the invention, objects, features and advantages thereof may be better understood from the following detailed description of the best mode for carrying out the invention when taken in connection with the accompanied drawings in which:

BEST MODE FOR CARRYING OUT THE INVENTION

Figure 1:
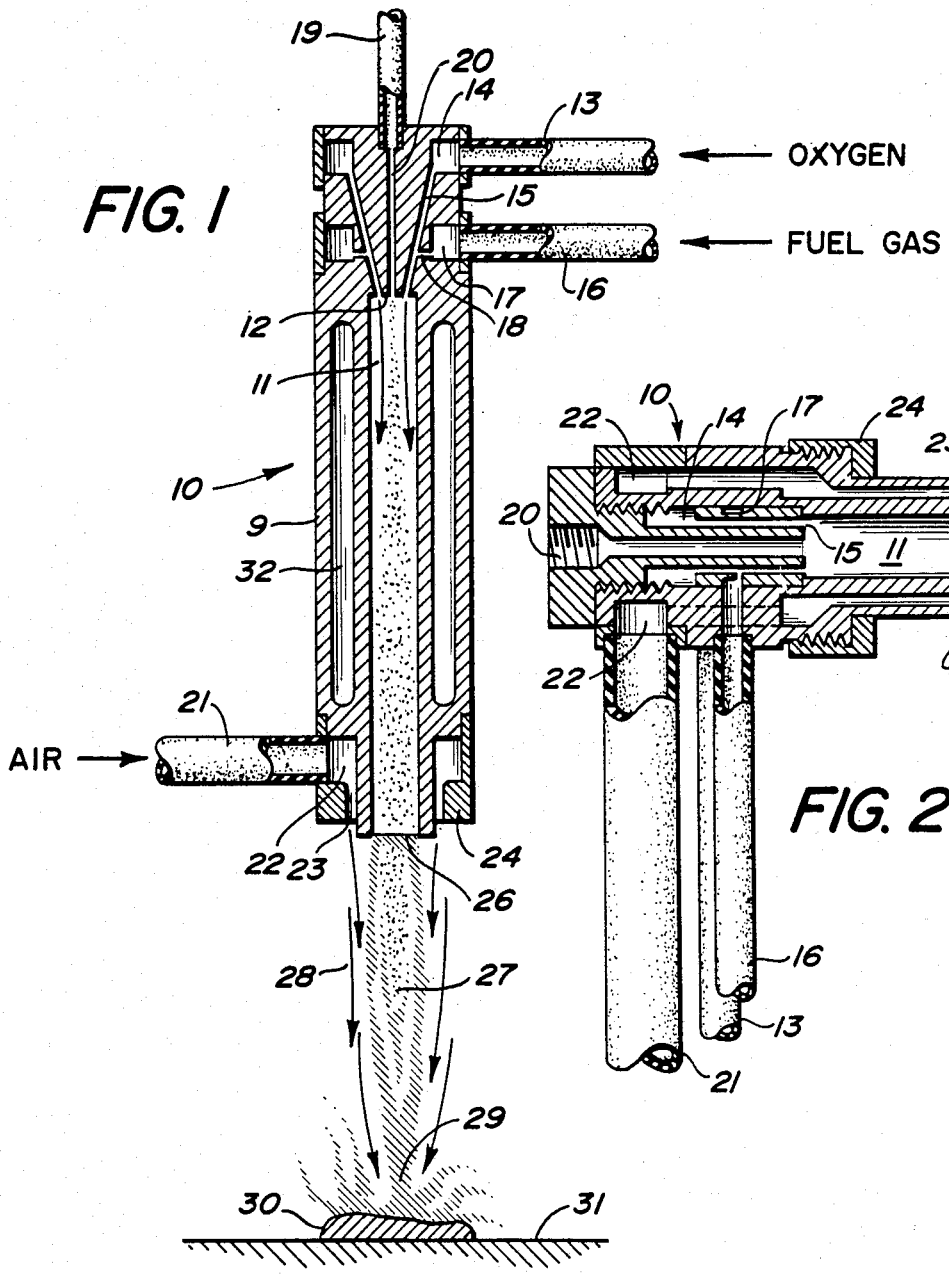
FIG. 1 is a cross-sectional schematic of a device illustrating the basic concept of the invention; and, FIG. 2 is a cross-sectional drawing of another embodiment of the invention.
Figure 2:
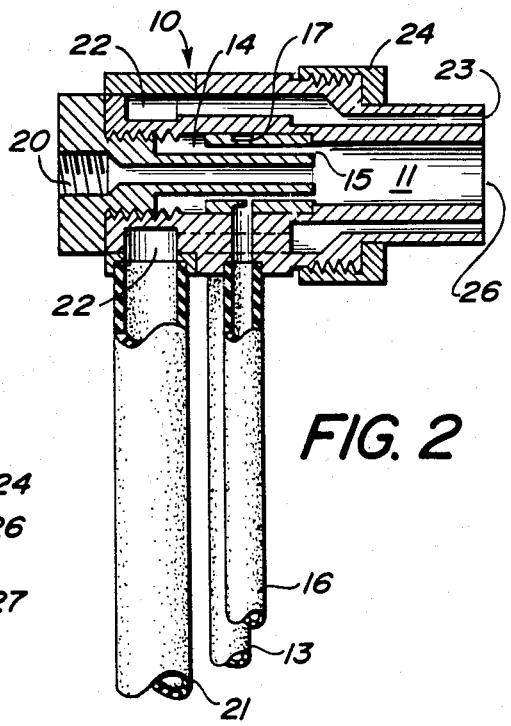

A better understanding of the principles of the present invention may be obtained from the figures which are cross-sectional views of preferred flame spray devices. Spray gun assembly 10 comprises the cylindrical body 9 which may contain cooling channels 32 and which surrounds an axial duct 11 terminating at the top at face 12 and open at exit 26 on the bottom. Oxygen for combustion enters annular manifold 14 through tube 13 to pass into duct 11 through multiple supply passages 15. Fuel gas from tube 16 is distributed to injector holes 18 by annular manifold 17. The oxygen and fuel both flow through portions of the supply passages 15 and are pre-mixed when they are discharged into duct 11 at face 12. Passages 15 are arranged preferably symmetrically about axial powder supply hole 20, through which powder in a carrier gas (or alternately a solid wire) passes from tube 19. The oxy-fuel reactants burn in their passage through duct 11, the walls of which define a columnar combustion region or chamber. By exit 26, the reacting gases and/or their products of combustion have reached relatively high velocity. With proper symmetry of flow, the powder stream is maintained as a narrow core positioned away from the wall of duct 11. The powdered material is heated to the softening point or may even be melted at this point.

The exiting hot gases, although at relatively high velocity, have low density and are not entirely capable, by themselves, of accelerating the heated particles to the desired high velocity values unless a greater-than-critical pressure drop occurs. For reasons to be discussed later, large pressure drops through duct 11 are not desirable.

To supplement the momentum of the hot primary stream 27, an outer sheath 28 of heated gas is provided (from, for example, a compressed air source, not shown) at a velocity approximating that of the inner hot gas flow. The sheath of secondary air 28 should, ideally, transmit very little of its kinetic energy or momentum to the particle flow with as little mixing as possible over an extended distance beyond exit 26. An extended hot region 27 is maintained for several inches beyond exit 26 in which the particles continue to receive heat and are accelerating in the primary stream. The secondary outer sheath 28 finally (at about point 29) combines turbulently with the hot flow of primary gases and adds its remaining momentum to the accelerating process. The particles are accelerated to high velocity to impact against workpiece 31 to form coating 30.

The blast air is provided through tube 21 to annular manifold 22 and forms sheath 28 by being discharged through annular nozzle 23, which is formed between an end cap 24 and the body, or through a closely spaced series of discharge holes (not shown) in end cap 24.

To reduce mixing of the hot inner gases with the cooler outer sheath, I have found that the two flows should have about the same velocity. The hot gas attains a velocity of about 1,800 Ft/Sec. (about 600 m/s) even for a pressure drop of less than a few pounds per square inch through duct 11. This is greater than is possible for usual atmospheric temperatures (about 70° F. or 20° C.) in which the sonic velocity for air is slightly greater than 1,100 Ft/Sec. (370 m/s). The mismatch of about 700 Ft/Sec. (230 m/s) between the two flows would create high shear and rapid mixing. A proper velocity match could be made using a supersonic sheath 28 velocity. This is undesirable, as extremely large air flows would be required and the uneven boundaries forced on the sheath flow would lead to rapid mixing.

However, by preheating the air (as by a resistance heater, not shown) a gas sheath velocity matching that of the 1,800 Ft/Sec. (600 m/s) inner hot flow (for example) is easily achieved. The air must be preheated to about 950° F. Sonic velocity for air at this temperature is about 1,810 Ft/Sec. Thus, a high but subsonic, flow of sheath gases is made to nearly match the hot gas velocity.

In essence, the invention provides a columnar flow of primary hot gases extending beyond a short duct and in which the particles to be sprayed are still being heated and accelerated. An outer sheath of heated secondary air encloses this inner hot flow, yet blends into it well beyond the duct to provide an additional momentum to that of the hot gases to help speed the particles to high velocity.

With a properly selected air flow rate and temperature, the heating zone beyond the torch exit visually becomes more concentrated and extended. Impact velocities of the particles against the workpiece are greatly increased, leading to coating qualities heretofore only available using plasma-arcs or other exotic techniques.

Where I have shown the air to be heated by in external source, a simpler method for low duct expansion ratios is to cool the duct using the air flow itself. The air can be heated to the desired temperature and no cooling water need be used.

Although the use of powder has been discussed, the principles of the invention are equally applicable to wire or rod feed devices.

While this invention has been described in detail with particular reference to a preferred embodiment thereof, it will be appreciated that many variations and modifications are possible, in light of the foregoing teachings, which can be effective within the spirit and intended scope of the invention as defined in the appended claims.

What is claimed is:

1. Apparatus for thermal spraying a coating material onto a substrate consisting essentially of:

a cylindrical body forming a combustion chamber having an exit end open to the atmosphere and an entrance end in communication with a source of combustible gas, a powder feed passage for introducing solid particulate material through said body and into said combustion chamber near said entrance end, and a blast gas passage in said body surrounding said combustion chamber and parallel thereto, said gas passage having an exit end adjacent the exit end of the combustion chamber, and having an entrance end adapted to communicate with a source of compressed air such that air flowing through said passage is warmed while cooling said body.

2. In a flame spray coating apparatus of the type having a high pressure combustion chamber which is in communication with gas means for supplying an oxy-fuel mixture to said chamber for combusting therein, means for introducing solid material into said chamber for heating therein, and exit means for discharging a stream of hot gases containing heated particulate material at high velocity, the improvement comprising:

means for forming an annular sheath of warm, high velocity uncombusted gas surrounding and flowing essentially parallel to said stream of hot gasses flowing from said exit means, and means for warming said high velocity gas while at the same time cooling said combustion chamber's wall, said means including gas passages formed in said combustion chamber's wall.

3. The apparatus of claim 2 wherein said means for introducing solid material comprises means for flowing powder in a carrier gas into said chamber along its central axis and opposite said exit means.

4. The apparatus of claim 2 wherein said means for introducing solid material comprises means for feeding a metalic wire into said chamber where it may be atomized by the hot gases of combustion.

5. In a method for flame spraying a coating of the type in which an oxy-fuel mixture is combusted in a duct to produce a high temperature and high velocity columnar flame jet which is used to heat and propel a solid material from the duct toward a substrate, the improvement comprising the steps of: providing a stream of uncombusted compressed air separate from the oxy-fuel mixture, heating said stream of air above ambient temperature by flowing said stream along the exterior of said duct while absorbing heat therefrom, and maintaining the exit velocity of said flame jet subsonic while surrounding said columnar flame jet with a co-axial sheath of expanded compressed air having a velocity which is sufficiently close to the velocity of said flame jet so that there is little initial mixing of said sheath and said jet.

6. The method of claim 5 in which the velocities of said flame jet and said sheath of expanded compressed air are subsonic only because of their high temperatures; their velocities being greater than the speed of sound at standard atmospheric temperatures.

7. The method of claim 5 in which solid particulate material is introduced into said duct, heated therein, and propelled therefrom in said high velocity flame jet toward a substrate.

8. The method of claim 5 in which a solid wire is introduced into said duct, atomized therein, and propelled therefrom in said high velocity flame jet toward a substrate.

9. The method of claim 7 wherein said solid particulate material is a fine ceramic powder and said high velocity flame jet has a temperature of at least about 950° C.

* * * * *